US005462783A

United States Patent [19]

Esselmann

[11] Patent Number: 5,462,783

[45] Date of Patent: Oct. 31, 1995

[54] LABEL DISPENSING SHEET

[76] Inventor: Dennis Esselmann, 1773 Audubon Ave., Grafton, Wis. 53024

[21] Appl. No.: 293,901

[22] Filed: Aug. 23, 1994

[51] Int. Cl.[6] ..... B42F 21/00; G09F 3/00

[52] U.S. Cl. ..... 428/40; 40/359; 40/360; 40/630; 40/641; 283/36; 283/37; 283/38; 283/39; 283/40; 283/41; 283/42; 283/43; 428/41; 428/42; 428/43; 428/121; 428/192; 428/212; 428/213; 428/220; 428/343; 428/354; 428/914

[58] Field of Search ..... 428/40–42, 121, 428/212, 213, 220, 343, 354, 914, 43, 192; 283/36–43; 40/641, 359, 360, 630

[56] References Cited

U.S. PATENT DOCUMENTS

| | | | |
|---|---|---|---|
| 3,473,827 | 10/1969 | Leadbetter | 40/641 |
| 4,523,776 | 6/1985 | Barber | 428/42 |
| 4,972,615 | 11/1990 | Grant | 40/641 |
| 5,182,152 | 1/1993 | Ericson | 428/42 |

*Primary Examiner*—Nasser Ahmad

[57] ABSTRACT

A label dispensing sheet for incorporation within a book such as a telephone directory, dictionary or the like, includes a facing sheet of heavy paper stock releasably secured to a relatively thin backing sheet or liner by a pressure sensitive adhesive and containing a series of indicia bearing labels or tabs adapted to be applied to the pages of the book to designate the various alphabetical headings, sub-headings, categories or divisions thereof. The facing sheet and liner have overlying, extended edges for binding the label dispensing sheet proper within the book with corresponding portions of these extended edges being die cut and perforated, respectively, to form a lock and release construction holding the sheet securely in place in the book while permitting its ready removal therefrom during tab assembly to the book pages. The labels have extended right and left halves for adhesively contacting opposite sides of the book pages and separated one from another by a scored center or crack line to insure ready, accurate folding of the labels during assembly to the book pages. The labels have edge markings such as dashes for aligning the labels with the edges of the book pages during assembly thereto to insure the labels have a uniform projection therefrom for ease of visibility and to present an extension suitable for gripping contact by the book user in turning to a desired section of the book.

3 Claims, 3 Drawing Sheets

FIG. 1
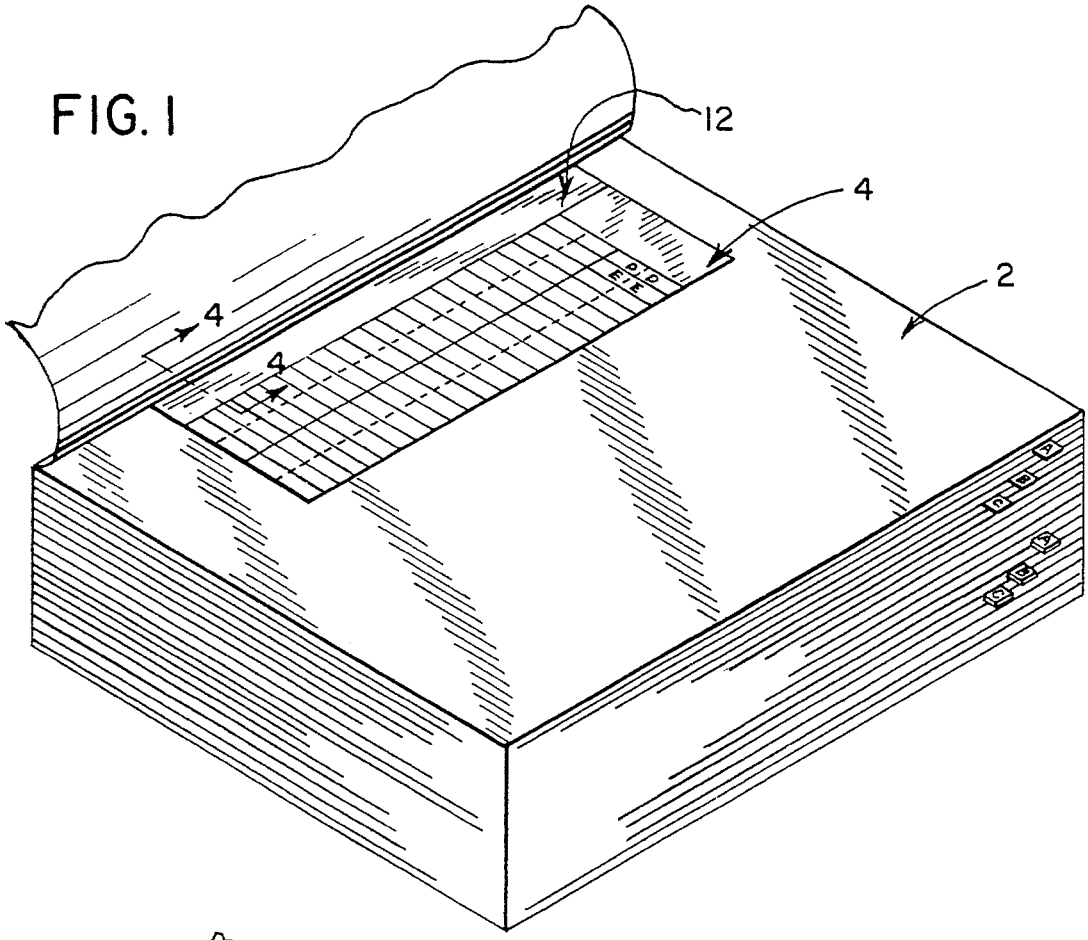
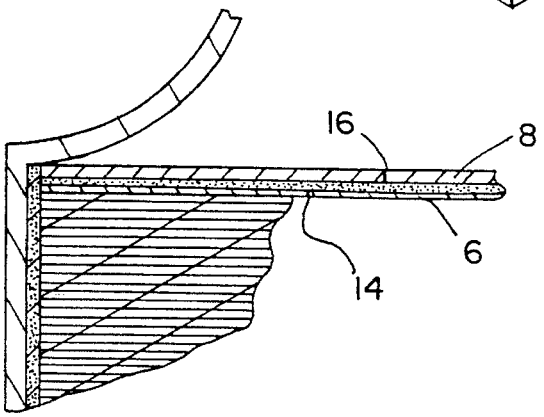
FIG. 4
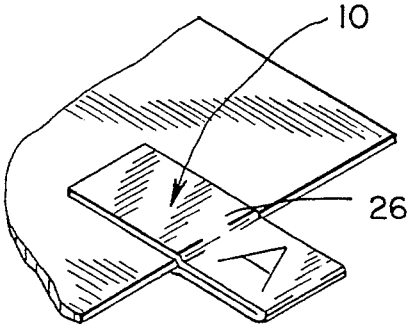
FIG. 9

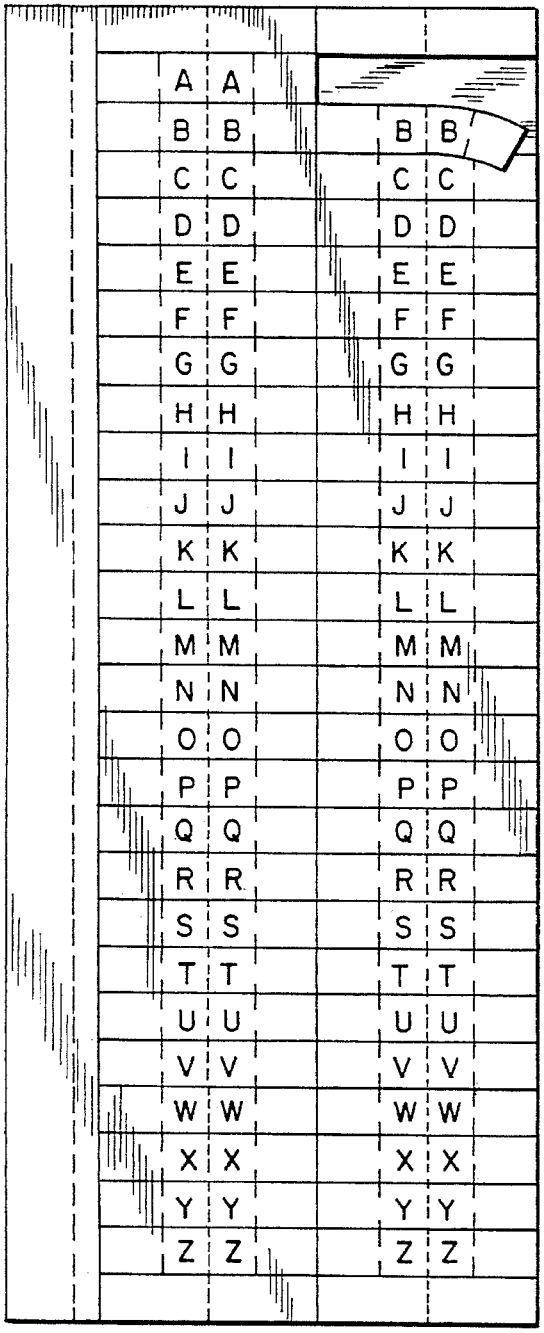
FIG. 5
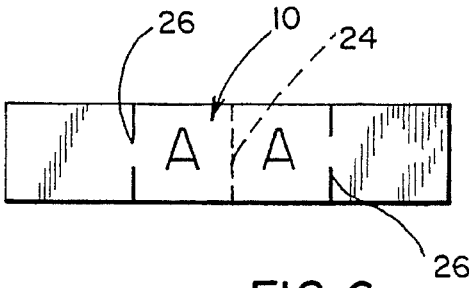
FIG. 6
FIG. 7
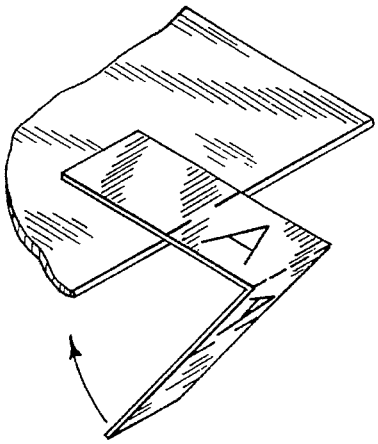
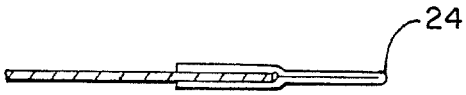
FIG. 8

LABEL DISPENSING SHEET

TECHNICAL FIELD

The present invention is directed to tabbing or indexing systems for books and more particularly concerns improvements in tabbing or indexing systems employing peel-off type tabs or labels adapted to be adhesively attached to the outer edges of selected book pages for ease of reference to the various divisions, chapters, categories, etc. of the book.

BACKGROUND OF THE INVENTION

The prior art discloses a number of different tabbing systems for use with books, such as dictionaries, encyclopedias, telephone directories and the like, see for example, Leadbetter U.S. Pat. No. 3,473,827, Horn U.S. Pat. No. 4,175,777, Ericson U.S. Pat. No. 5,182,152, and Remmey III U.S. Pat. No. 3,958,816. Such systems generally include a plurality of peel-off type index tabs arrayed on a paper backing sheet usually in one or more rows and/or columns. The tabs or labels are imprinted with suitable indicia such as the letters of the alphabet or a series of numbers, for example, whereby the separate divisions, chapters, or other distinctive sections of the book may be suitably marked or indexed by applying a corresponding one of the tabs or labels to the outer edge of the particular page of the book located at the beginning of such division, chapter or section of the book. Thus, for example, in the case of a dictionary, a label or tab bearing the letter "A" could be applied to the outer edge of the initial page of the dictionary containing the words beginning with the letter "A". Similarily, the labels bearing the indicia "B", "C", "D" and so forth would be applied to the corresponding pages of the dictionary containing the start of words beginning with the letters B,C, and D, etc., respectively, with each successive letter placed on the page of the dictionary or other book or publication just under the label or tab preceding it in the dictionary or other book or publication. Index tabs or labels of this general description can greatly improve the usefulness of the book with which they are used by permitting a user of the book to rapidly access a desired page, chapter or subject of the book, depending upon the classification employed in initially applying the tabs or labels to the book.

Despite the obvious utility of these general types of tabbing or indexing systems, present designs have not enjoyed widespread usage for one or more of a number of reasons. More specifically, with some of these existing constructions, the labels or tabs are formed of relatively thin paper or other material and it is often difficult to separate the tabs or labels from the thicker paper backing or stock to which they are adhesively attached without tearing or otherwise damaging the tabs or the labe bearing sheet proper. At best, the removal of individual tabs is a cumbersome and tedious process.

In the typical application, the tabs when mounted to the book pages extend from the page to present a gripping surface to the book user. In opening the book to access a particular chapter or desired section of the book, the tab extension is normally gripped or held by the user rather than the book page itself and the tab may be rather severely stressed in this process as well as the page to which the tab is attached. In the normal design, the tabs are not particularly suited to withstand repeated usage without incurring permanent bending or even tearing. The book pages themselves may tend to tear at the points of attachment to the tabs under repeated or rough handling due to this use of the tabs as the gripping means. The susceptibility of the tabs to bend and/or to tear under repeated usage and the problem of the tearing of book pages to which the tabs are attached detracts considerably from the utility of presently known tabbing systems.

Another drawback of present designs of tabbing systems is the lack of a ready means for mounting the tabs or labels to the book pages uniformly and accurately with respect to the edges of the pages.

The present invention addresses the above mentioned shortcomings of conventional tabbing or indexing systems and provides an indexing or tabbing system of overall improved construction and enhanced utility for use particularly with telephone directories, dictionaries and the like.

SUMMARY OF THE INVENTION

A tabbing or indexing system according to the invention includes a label dispensing sheet of multiple layer construction, being formed of a facing sheet of relatively heavy paper stock and a relatively thin liner releasably secured together by a pressure sensitive adhesive. The facing sheet and liner have extended edge portions to permit the composite label dispensing sheet to be bound within a book such as a telephone directory or dictionary to form an integral part thereof. The extended edges are die cut in the case of the facing sheet and perforated in the case of the liner to provide a lock and release construction permitting the main portion of the label dispensing sheet to be readily removed from the book as desired during the actual tabbing or indexing operation while retaining the sheet securely in place in the book until use.

The heavy gauge facing sheet is provided with a series of peel-off labels or tabs arranged in one or more columns on the sheet. The labels are imprinted with suitable indicia, letters or numbers, for example, and are separated one from another for ease of removal from the sheet by score or cut lines extending in both directions of the sheet in perpendicular relation with one another. The labels feature extended right and left halves separated by a scored or perforated, center fold or crack line and when applied to the book pages the individual half sections are folded back upon one another and upon both the front and back side of the book page using the fold or hinge line as the axis of the fold. A double tab thickness is thus provided with both sides of the tab in firm, adhesive contact with the book page.

According to a further aspect of the invention, the tabs or labels are provided with dots, dashes or similar such markings along each edge for use in aligning the labels with the edges of the book pages during the tabbing operation thereby insuring uniformity in label application to the book pages.

According to a particularly novel feature of the invention, the facing sheet of the composite label dispensing sheet is provided with a protective coating of a transparent material to impart a measure of smudge and scratch resistance to the imprinted matter on the labels. In a preferred embodiment, the coating material is glassine both to impart bio-degradability to the labels while providing the labels an enhanced resistance to scratching, marring or smudging over extended periods of usage.

BRIEF DESCRIPTION OF THE DRAWINGS

In the drawings:

FIG. 1 is a perspective view of a telephone directory incorporating the novel label or tab dispensing sheet of the invention;

FIG. 4 is an enlarged sectional view of the label dispensing sheet of the invention as incorporated within a telephone directory, the view being taken along the lines 4—4 of FIG. 1;

FIG. 5 is a plan view of the novel label dispensing sheet of the invention;

FIG. 6 illustrates one of the novel tabs or indices of the label dispensing sheet;

FIG. 7 is a fragmentary perspective view showing the manner of mounting an index or tab to the edge of a book page;

FIG. 8 is an enlarged edge view of aa index or tab in assembled position on the edge of a book page; and FIG. 9 is a view similar to FIG. 7 showing the index or tab in finally assembled position on a book page.

DETAILED DESCRIPTION OF PREFERRED EMBODIMENTS

Figure 2:
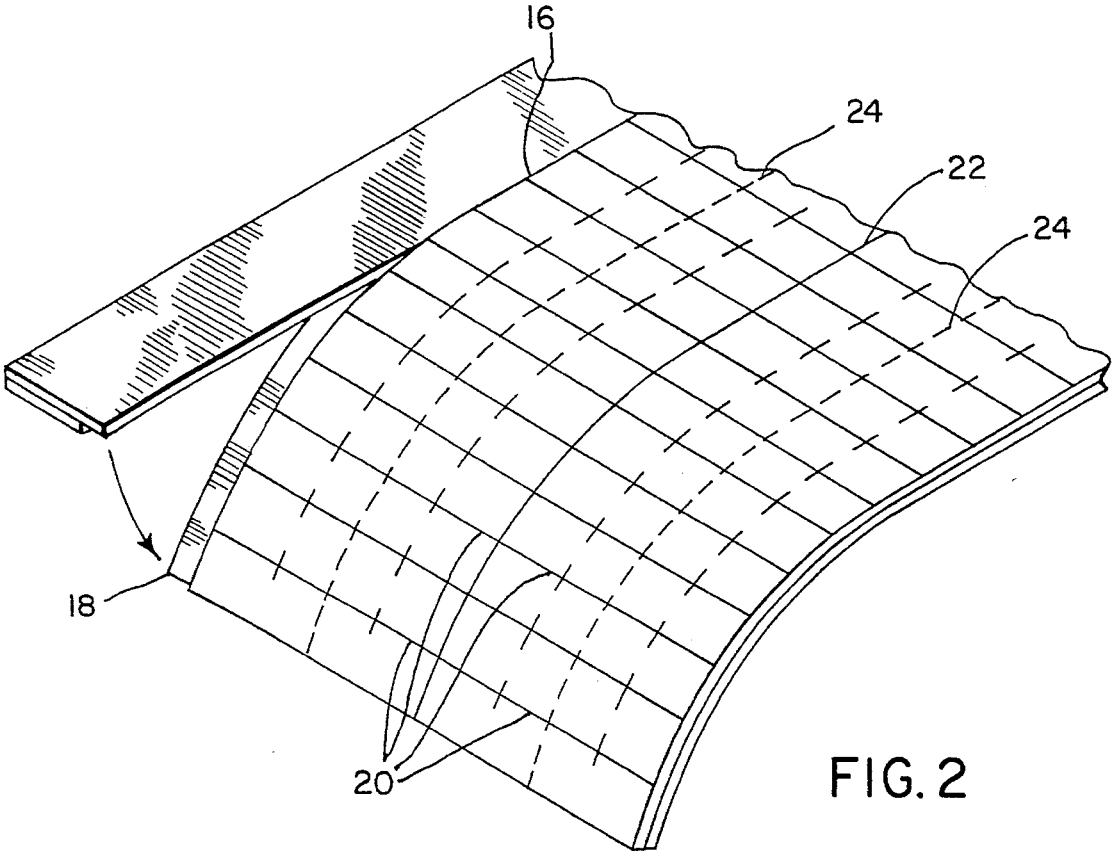
FIG. 2 is a further perspective view of a fragmentary portion of the label dispensing sheet of the invention illustrating the manner in which the sheet may be separated from its extended binding edge.

With regard now to the drawing and to FIG. 1 in particular, the improved tabbing system of the invention is shown in conjunction with a telephone directory (2) of the type having a first section containing a listing of the telephone numbers of the residences in the area served by the directory arranged in alphabetical order according to the last names of the individuals and families at such residences and a second, separate section listing by general category or classification and in alphabetical order the various businesses and companies in the general geographical area covered by the directory. It is well to recognize, however, that the system of the invention may be employed in an equally advantageous manner with a wide variety of other printed publications, including dictionaries, encyclopedias, catalogues, data books, etc.

The indexing system of the invention comprises a generally rectangular shaped, multiple layer index or label dispensing sheet, indicated as a whole by the reference numeral 4, formed of a liner 6 of relatively thin paper stock and a facing sheet 8 of a relatively heavey gauge paper stock. Typically, the liner has a thickness ranging between 0.003 and 0.0045 inches while the facing sheet thickness will range between 0.008 and 0.012 inches. The heavier gauge facing sheet 8 is provided with a series of individual labels or tabs 10 as will be more specifically described hereinafter and is releasably secured to liner 6 by a suitable pressure sensitive adhesive. Label dispensing sheet 4 is sized in relation to the individual pages or sheets of the book with which it is to be utilized so as to fit comfortably within or between said pages or sheets preferably without projecting therefrom in either direction.

Label dispensing sheet 4 is formed with an extended left-hand edge or marginal portion 12, as the sheet is viewed in FIG. 5, for example, designed to permit the sheet to be bound integrally within directory 2 with the directory pages as by a hot melt process, stitching, stapling or other conventional binding process. In the normal application, sheet 4 will be bound inside the front cover or title page of the directory or other publication with which it is employed but it will be appreciated that the sheet may be positioned at any other alternative position in the directory, book or publication, if preferred.

Figure 3:
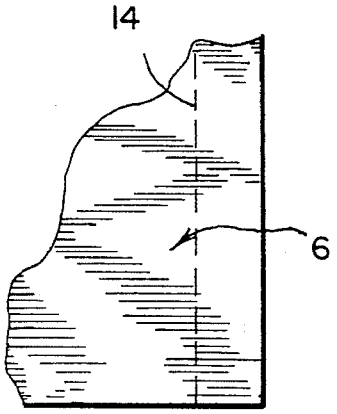
FIG. 3 is a partial plan view of the extended binding edge portion of the liner portion of the label dispensing sheet.

The extended edge 12 of sheet 4 is bounded along the right side in the case of liner 6 by a perforation line 14 as may best be seen in FIG. 3 while in the case of facing sheet 8 the right side is bounded or defined by a die cut or score line 16 which in the illustrated form of the invention is shown to be offset slightly to the right of perf line 14. The aforesaid construction provides a lock and release type construction permitting the label dispensing sheet to be readily removed from directory during the tabbing or indexing operation by applying an outward and/or downward force to the right hand edge portion of the sheet while holding the directory firmly in place. FIG. 2 best illustrates this removal procedure. At the same time, with this construction the label dispensing sheet is secured rather firmly to the directory so as to resist inadvertent or accidental removal or dislodgement.

Due to the offset relation between perf line 14 and score line 16, it will be noted that an edge portion 18 of liner 6 will be exposed when label dispensing sheet 4 is removed from the directory or other book in the manner described. As a result, the removal of the individual labels from liner 6 may be accomplished simply by bending or flexing the label dispensing sheet 4 sufficiently to separate liner 6 and facing sheet 8 along die cut line 16 and pulling back on the exposed edge of the particular label desired to the extent necessary for its removal from the liner.

In some applications, it may be preferred to simply insert the label dispensing sheet loosely in the directory or other book or publication with which it is used or it may wrapped together as a package with such directory, book or publication. Also, of course, the label dispensing sheet may be marketed as a separate item for use with directories, books or publications already on the market or in the hands of consumers.

The labels or tabs 10 are arrayed on facing sheet 8 in one or more columns extending the length of the sheet. For usage with a telephone directory of the type described hereinabove, it is contemplated to employ a double set of labels arranged in side-by-side relationship whereby one set of tabs may be employed for the first section of the directory consisting of the residential phone numbers in the area while employing the second set of tabs for the area businesses, offices and institutions and the like.

The individual tabs or labels 10 are defined by scoring or die cutting the facing sheet along its width at a series of equi-spaced intervals and by similarily scoring or die cutting the facing sheet in a lengthwise direction at a location between the columns. The reference numerals 20 and 22 are used to indicate the lateral and longitudinal cuts or score lines, respectively, in the facing sheet. Facing sheet 8 is further provided with a line of weakening extending the length of the sheet at the center or mid-point of each of the columns of labels, as indicated by the reference numerals 24. Lines 24 define a center hinge or fold or crack line for the individual labels such that despite the heavy stock used for sheet 8, the labels may be creased or folded precisely and neatly about their center line in the process of application to the book pages. FIGS. 7 to 9 of the drawings best depict this aspect of the invention.

Labels or tabs 10 feature a double sided construction, being formed with extended right and left hand sections which are mirror images of one another as respects center fold line 24. In applying the labels to the edge of a book page, the weakened fold line 24 serves as a center hinge or axis as stated hereinbefore with the opposed tab sections folding back upon one another and attaching to the opposite faces or sides of the page. The opposed sections of the tabs have identical indicia or characters imprinted thereon. Thus in the illustrated embodiment wherein the labels or tabs bear the letters of the alphabet, the half sections of the first label in the column carries the letter "A"; the next successive label carries the letter "B" on each of its opposed sections; and so on through the letters of the alphabet proceeding down the separate columns of labels. The double indicia enables the tabs to be read from either side of the directory, thus making it unnecessary to turn the directory back to the first pages in order to survey all the letters "A" to "Z".

The edges of the labels are marked with dashes, dots or other such symbol, herein indicated by the reference numeral 26, for aligning the labels or tabs with the edges of the book pages during the tabbing or indexing operation. Through the use of these markings, the successive tabs will project a uniform distance from the book pages when applied thereto, resulting in a neat appearing, easy to read series of tabs in the finished directory. The construction of the invention also insures the tabs will afford to the user an exposed face of sufficient area to enable sure, ready grasping thereof by the used in opening the directory to any desired alphabetical listing of names or categories of businesses.

A clear or semi-opaque coating is applied to the outer side of facing sheet 8 in order to provide a measure of resistance to smudging, marring or scratching of the labels and the printed indicia in particular during usage. In a preferred embodiment, it is contemplated to utilize glassine as the coating material on facing sheet 8 as this material not only is bio-degradable and hence more environmentally acceptable but also imparts to the tabs a greater degree of resistance to scratching, marring, rub-off and the like during usage of the tabs.

In the use of the tabbing and indexing system of the invention, the individual tabs in the dual columns are peeled one at a time from liner 6 and applied to the pages of the telephone directory or other book or publication in a desired sequence, placing the appropriate tabs on the particular directory pages containing the listing of the residences and/or categories of businesses in the geographical area covered by the directory corresponding alphabetically to the letters on the tabs. The double sided construction of the tabs, utilizing extended side potions adhesively engaging both faces or sides of a page, coupled with the heavy gauge stock used for the facing sheet, results in an extremely durable tab construction capable of withstanding prolonged usage without tearing either of the tabs themselves or the pages to which they are attached.

Various modes of carrying out the invention are contemplated as being within the scope of the following claims, particularly pointing out and distinctly claiming the subject-matter regarded as the nature of the present invention.

I claim:

1. A tabbing or indexing label dispensing sheet of multiple layer construction for indexing a book, comprising a 0.003 to 0.0045 inch thick paper liner, and a facing sheet of 0.008 to 0.012 inch thick paper stock releasably secured to said liner by a pressure sensitive type adhesive, said liner and facing sheet having overlying, extended marginal portions for binding the label dispensing sheet within said book, said extended marginal portions being die cut in the case of the liner and perforated line in the case of the facing sheet, both being parallel and spaced apart from a longitudinal edge of said sheet, to provide a lock and release construction holding said label dispensing sheet securely in said book while permitting its ready removal therefrom during indexing of the book, said die cut in said liner and said perforation line in said facing sheet being offset with respect to one another, said facing sheet formed with a series of indicia bearing labels for application to selected pages of the book along the edges thereof to mark the particular divisions of the book according to content, said labels having right and left-hand sections separated by a scored center fold line enabling said sections to be folded back upon one another and upon the front and rear faces of the book pages in the assembled position, said half sections of the labels being inscribed with edge markings for aligning labels with the page edges during assembly thereto to maintain a uniform projection of the labels from the book pages in their assembled position.

2. The construction of claim 1 wherein said labels are arrayed in a plurality of similar columns on the facing sheet, each such column containing a full set of labels bearing the desired indicia.

3. The construction of claim 1 wherein said facing sheet is provided with a protective coating of a transparent material.

* * * * *